US005628454A

United States Patent [19]

Heim et al.

[11] Patent Number: 5,628,454

[45] Date of Patent: May 13, 1997

[54] FOOT SUPPORT MODIFICATION FOR RAILROAD RAILS

[75] Inventors: Armin Heim, Kreuzlingen, Switzerland; Otto Morgenschweis, Mering, Germany

[73] Assignee: Schwihag GmbH, Taegerwilen, Switzerland

[21] Appl. No.: 626,978

[22] Filed: Apr. 3, 1996

Related U.S. Application Data

[63] Continuation of Ser. No. 333,352, Nov. 2, 1994, abandoned, which is a continuation of Ser. No. 87,522, Aug. 31, 1993, abandoned.

[30] Foreign Application Priority Data

Jul. 8, 1992 [DE] Germany ..... 42 22 381.4
Oct. 9, 1992 [DE] Germany ..... 42 34 007.1

[51] Int. Cl.[6] ..... E01B 5/02; E01B 9/38

[52] U.S. Cl. ..... 238/306; 238/264; 238/304; 238/307

[58] Field of Search ..... 238/264, 278, 238/287, 304, 306, 307

[56] References Cited

U.S. PATENT DOCUMENTS

| | | | |
|---|---|---|---|
| 857,781 | 6/1907 | Abbott | 238/306 X |
| 898,709 | 9/1908 | Whitbread | 238/306 X |
| 1,156,754 | 10/1915 | Carney | 238/306 X |
| 1,752,451 | 4/1930 | Muller . | |
| 1,834,890 | 12/1931 | Bell | 238/304 |
| 1,870,440 | 1/1932 | Boyce | 238/298 |
| 2,094,335 | 4/1937 | Willard et al. | 238/304 |
| 2,133,317 | 10/1938 | Anthonisen | 238/304 X |
| 3,496,882 | 2/1970 | Campbell et al. | 107/2 |
| 4,155,507 | 5/1979 | Chierici et al. | 238/307 |
| 4,971,247 | 11/1990 | Harkus | 238/306 X |

FOREIGN PATENT DOCUMENTS

| | | | |
|---|---|---|---|
| 2594153 | 8/1987 | France | 238/307 |
| 786483 | 11/1957 | United Kingdom . | |

*Primary Examiner*—S. Joseph Morano
*Attorney, Agent, or Firm*—Watson Cole Stevens Davis, P.L.L.C.

[57] ABSTRACT

A sole, ribbed or slide chair plate for a foot of a railroad rail provided with two spaced flat bearing surfaces between which is a concave surface allowing for non tipping of the rail when in place if the bottom of the rail has a convex surface and a shim fitting on top of the plate having a top surface composed of two spaced flat bearing surfaces between which is a concave surface.

11 Claims, 5 Drawing Sheets

FOOT SUPPORT MODIFICATION FOR RAILROAD RAILS

This application is a Continuation of application Ser. No. 08/333,352, filed Nov. 2, 1994, which in turn is a Continuation of application Ser. No. 08/087,522, filed Aug. 31, 1993, now abandoned.

BACKGROUND OF THE INVENTION

The present invention relates to a modification to foot supports for railroad rails that are used in track systems (rails and switches), this being arranged in the vicinity of rail-securing devices on ties or similar track-holding elements. In this connection, a sole plate or a ribbed plate, respectively, a slide chair plate or the like, or simply a shim can be provided, the sole plate or ribbed plate, slide chair plate or shim this lying on the top of the tie or the like and being secured to the by means of coach bolts or the like.

The railroad rails that are used for track construction are designed as so-called wide bottom flange rails that are of a modified T cross-section, the rail head being of a mushroom-shaped cross-section. Such wide-bottom flange rails are known, for example, by the designations UIC54 or UIC60, respectively, as well as S 49 or S 54 shapes, etc., and have a cross-section that is symmetrical about their vertical axis y—y. The axis of symmetry y—y is perpendicular to the centroidal axis x—x of a wide-bottom flange rail. The centroidal axis x—x is located at a considerable distance (approximately 10 mm) beneath the half total height of the rail cross-section. These wide-bottom flange rails are rolled with the Y-axis horizontal. This method, used to roll the wide-bottom flange rails—which is governed by the configuration of the profile—results of necessity in the fact that their (underside) foot support area undergoes a slightly convex-crowned shaping towards the vertical axis y—y. Because of this, in contrast to a horizontal ideal plane, the rail foot supporting surface has a crown in the area of the vertical axis y—y, and this can amount to 0.2 and 0.4 mm. It is difficult and unusual to eliminate this crown by way of alignment.

Because of this crowning of its foot support surfaces, which is caused by rolling technology, the wide-bottom flange rails that are used in track systems stand in a way that is mechanically unstable on the associated sole plates or on the shims, respectively, e.g., in the case of concrete ties, or on ribbed plates.

This unstable rail position is particularly critical if the supporting surfaces, in the case of ribbed plates on wooden ties, for example, is not flat but rather deformed in a more or less convex shape that is opposite to the crowning of the rail foot supporting surface, for then, for all practical purposes, two oppositely curved surfaces are in contact only on a line that extends along a common apex. Since both the convexity of the rail foot supporting surface as well as that of the supporting surface on the sole plate that faces towards this result in a crown, it is impossible to achieve an exact and stable starting position for bracing the rail feet by means of a rail attachment device. For this reason, when the rail attachment device is tightened, their vertical axis of symmetry y—y can tip either inwards or outwards by an amount that depends on the crowning, and this can lead to a reduction or enlargement of the cross-rail distance (track) in the rail section or in switches.

The crowning that occurs in the rail foot supporting surface and the sole plate leads to a further disadvantage in that—particularly in the case of interior curve or exterior curve switches that are subjected to heavy loads—the edges of the rail foot sink into the inner bearing surface of the outer ribs of the sole plates that are used very rapidly and very deep, as a result of the tilting movements that are caused by the unstable position of the rails. This fact leads not only to an uncontrolled and thus hazardous widening of the track width in the track, but also to the fact that the ribbed plates, and in particular the ribbed sliding chair plates, become unserviceable very quickly and thus have to be replaced, sometimes after they have been installed for only a short time.

A further disadvantage that occurs as a result of convex supporting surfaces is that the rails can move sideways as a result of forces applied by the wheels. The rotation of the rail head that is caused by this changes the geometry of the line of contact between the wheel and the rail. The rolling characteristics of rolling stock can be affected very adversely because of this, particularly at high speeds.

In consideration of the disadvantages described above, which result from the use of railroad rails that are rolled when horizontal and used for track construction, it is the task of the present invention to create a modification for the foot supports for railroad rails with the typical characteristics described in the introduction hereto, and which, using simple means and, for all practical purposes, with no extra cost ensure a stable positioning of railroad rails relative to the other functional elements of track systems and switches, particularly in the vicinity of the rail attachment points on ties or corresponding track-securing elements.

SUMMARY OF THE INVENTION

In order to achieve this objective, or to solve the problem posed thereby, the present invention provides mainly for the fact that the rail foot supporting area of the sole plate or of other supporting surfaces such as, for example—in the case of concrete ties—of a shim, has only flat supporting surfaces, which run in the form of two strips and, in each instance, lateral sectors that are associated with the two longitudinal edge zones of a rail foot, whereas the—middle—section that lies between these zones has an area that is set back relative to its common plane.

Tests have shown that by using the measures proposed by this invention, tipping and/or lateral horizontal displacement of a railroad rail relative to the sole plates, in the vicinity of the rail attachment devices, can be avoided safely, because the supporting surfaces of the rail foot and the sole plate that face each other are supported in a stable manner over a relatively large cross-section area and fit into each other without any problem. A particularly advantageous development of the present invention is that the middle, mold-face lateral section extends with a concave curvature between the two strip-like lateral sections and has its maximum depth of arc at the approximate midpoint between the two strip-like lateral sections. The convex curvature of the foot support area on the railroad line can thus fit without hindrance into the concave curvature of the shaped surface lateral sections, and thereby contribute to a stabilizing effect, in particular against lateral displacement of the rail foot support.

It has been found to be particularly advantageous if the width of each individual flat supporting surface of the sole plate or the like is at a ratio of approximately 1:4 or 1:6 to the total width of the rail foot, with, in addition, the greatest arc depth of the shaped surface side section to its width being in a proportion that is somewhere between 1:166 and 1:100. If the shaped surface lateral section is 100 mm wide, then the maximum arc depth of this should be between 0.6 and 1 mm. Since, in practice, the convex crowning of the rail foot supporting surface can easily amount to between 0.2 and 0.4 mm, in every instance it is ensured that, in the vicinity of the rail attachment devices, tightening the rail foot to the sole plate by using the associated bracing elements does not lead to an undesired change in the position of the railroad rail on the sole plates or the like and, from the mechanical standpoint, the positioning of the rail on these two strips can be regarded as stable.

Because of the fact that the railroad rails in the track are customarily installed with a specific transverse inclination (e.g., 1:40), it is obvious that, according to the present invention, the common plane of the two supporting surfaces on the sole plate that are in the form of strips will run with this usual transverse inclination (1:40) or with other customary inclinations relative to the horizontal.

Principally in the case of cast plates it may be expedient to carry out cutting-type machining of the two strips at very close tolerances in order to arrive at transverse and longitudinal parallellity of the supporting surfaces relative to the total surface.

According to another proposed solution according to the present invention, a modification to the foot surface of railroad rails of the kind described in the introduction hereto is characterized by a shim that is associated with the rail foot supporting area of a sole plate, which has on its upper side only a flat supporting surface that extends in two strip shapes and in each instance lateral sections that are associated to the two longitudinal edge zones of a rail foot, whereas the lateral section that is located between these is provided with a mould face that is set back relative to its common plane.

Thus, whereas according to the first quoted proposal according to the present invention, a specially designed sole plate, for example, a ribbed plate, slide chair plate, or a shim, or the like, is used for each rail attachment device, the additional proposed solution is aimed at making the sole plates customarily used in the vicinity of the rail attachment devices reusable and to associate only a shim of plastic or similar material, designed according to the present invention, with them.

Because of the fact that the sole plates, namely, ribbed plates, slide chair plates, or the like, or even only plastic shims, that are used with rail attachment devices, either because of the way they are manufactured (rolling or casting or injection-moulding), and/or as a result of them being tightened onto the ties or similar track retaining elements, can have a shape that is detrimental to stable installation of the rail foot supporting surface imparted to them in the rail foot supporting area, in a further embodiment of the second proposed solution, the present invention proposes that the underside of the shim also be provided with a mold face that is set back or curved concavely and which runs in the transverse direction of the rail foot. A shim that is formed in this way thus evens out irregularities both in the foot supporting surface of the rail foot as well as irregularities in the rail foot supporting area of the sole plate, and does this in an optimal fashion.

According to the present invention it is also worthy of recommendation that the underside or concavely curved shaped surface of the shim, which is of plastic or even of rubber, extends at least across almost the whole width of the shim.

BRIEF DESCRIPTION OF THE DRAWINGS

The present invention will be described in greater detail below on the basis of embodiments shown in the drawings appended hereto. These drawings show the following.

DESCRIPTION OF THE PREFERRED EMBODIMENTS

Figure 1:
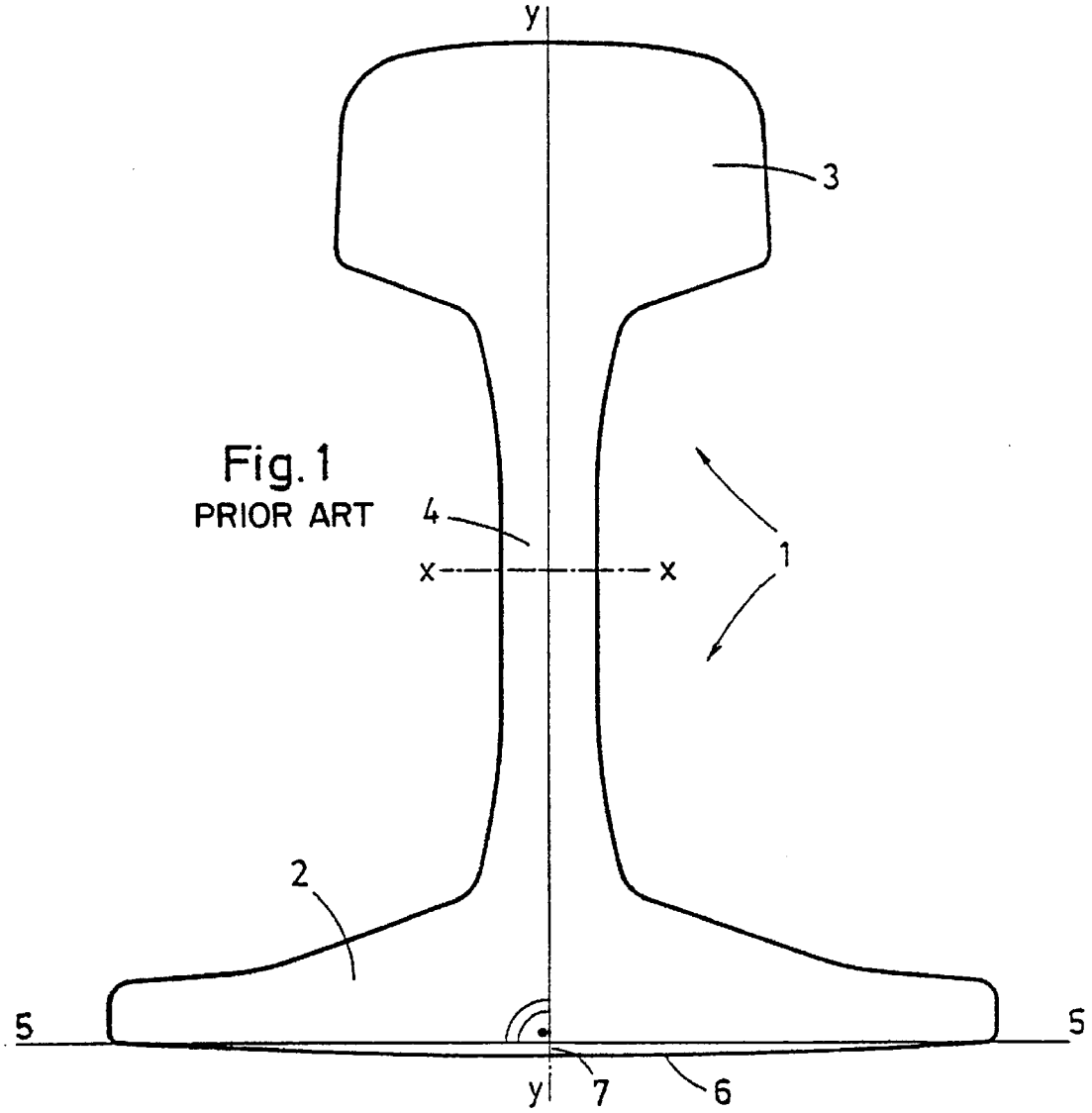
Fig. 1 PRIOR ART
FIG. 1: the cross-section profile of a railroad rail, for example, a wide-bottom flange rail designated UIC60 or UIC54, this being manufactured by rolling in the horizontal position.

The railroad rail 1 shown in FIG. 1, which has a UIC60 rail profile, is a so-called wide-bottom flange rail that is characterized in that the rail foot 2 is made particularly wide in order to provide a better stability on the base, whereas the rail head 3 is mushroom-shaped. The railroad rail 1 has a profile that is symmetrical about its vertical axis y—y and the axis x—x that crosses the vertical axis y—y horizontally is at a height such that its distance from the standard plane 5—5 of the supporting surface 6 for the rail foot 2 amounts to approximately 0.47 of the total profile height of the railroad rail 1. Thus, for rail profile UIC60, at a total profile height of 172 mm, the centroidal axis x—x is at a distance of approximately 81 mm above the standard plane 5—5 for the support surface 6 of the rail foot 2.

Figure 2:
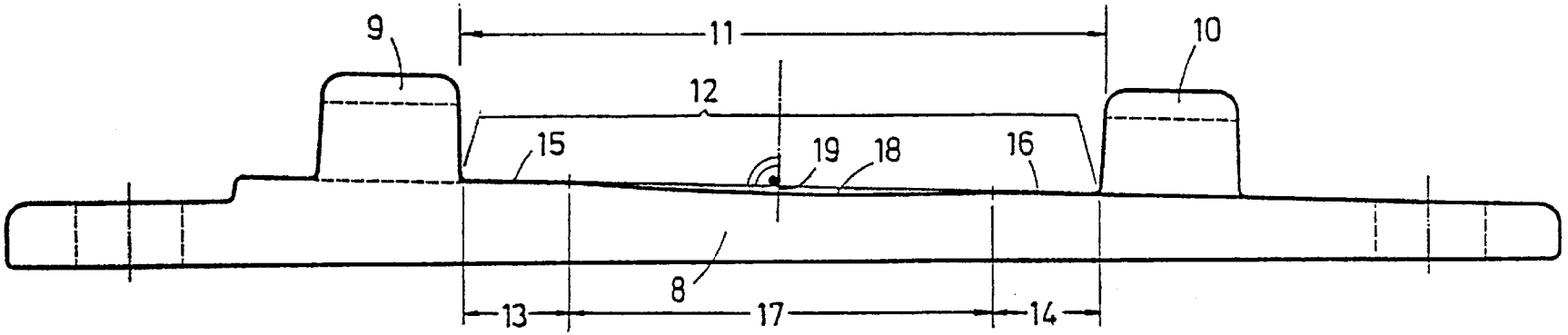
FIG. 2: a sole plate in the form of a ribbed plate, that is to be installed in the vicinity of the rail attachment devices in track systems, this being in the form of a ribbed plate that incorporates a foot support modification for a railroad rail as in FIG. 1 and which is manufactured, for example, as a rolled, extruded, or cast profile.

In the vicinity of each individual rail attachment device, the railroad rail 1 works in conjunction with a sole plate 8 through its rail foot 2, as is shown in FIG. 2, viewed in the direction of the longitudinal axis of the rail. Each sole plate 8 rests on the top surface of a tie or of a corresponding rail-retaining element and is secured to this, for example, through carriage bolts or the like.

In the embodiment shown in FIG. 2, the sole plate is in the form of a rib plate 8, produced mostly as a rolled steel preform.

The sole plate or rib plate 8, respectively, shown in FIG. 2 has between its rib profiles 9 and 10, which are arranged on its upper side, a lateral space 11 which is somewhat greater than the width of the rail foot of the railroad rail 1 shown in FIG. 1. The ribs 9 and 10 define the rail foot supporting area of the sole plate or rib plate 8 between themselves. This rail foot supporting area 12 is, in its turn, divided into two strip-like lateral sections 13 and 14 that run along the ribs 9 and 10; each of these has completely flat supporting surfaces 15 and 16 and, in a section 17 that is located between them, a mold face 18 that is slightly set back relative to the common plane of the supporting surfaces 15 and 16; this can be seen clearly in FIG. 2.

The mold face 18 has a concave curvature within the lateral section 17, and this curvature is so configured that its greatest depth of arc 19 lies approximately mid-way between the two strip-like lateral sections 13 and 14.

The width of each of the lateral sections 13 and 14 that form a flat supporting surface 15, 16, respectively, is preferably such that it is at a proportion of 1:4 to 1:6 to the width of the total rail foot supporting area 12 that is determined by the space 11. Furthermore, the maximum depth of arc 19 of the mold face 18 in the vicinity of the sector 17 should be at a ratio of somewhere between 1:166 and 1:100 to its width.

Thus, given a width of 150 mm for the rail foot 2, each flat supporting surface 15 and 16 would have a width 13, 14 of 25 to 30 mm, respectively, which would then result in a width dimension of approximately 102 to 92 mm for the middle section 17. In the latter case, the maximum depth of arc 19 of the mold face 18 within the section 17 would be between 0.6 and 1 mm.

FIG. 2 also shows that the common plane of the two strip-like supporting surfaces 15 and 16 on the sole plate or ribbed plate 8, respectively, are inclined by a certain amount relative to the horizontal. This transverse incline is customarily at a ratio of 1:40 or 1:20, or the like, in order to match a corresponding transverse inclination of the running surface of the railroad rail 1 to the conical rim shape of the wheels.

If the railroad rail 1 is set on the sole plate or ribbed plate 8 with its rail foot in the area of the space 11, i.e., between the ribbed profiles 9 and 10, then only two of the longitudinal edge zones of the rail foot 2 or of its supporting surface 6 will rest on the two flat supporting surfaces 15, 16 of the sole plate or ribbed plate 8. In contrast to this, the section of the convexly crowned supporting surface 6, with its arc height 7, which lies between these will be accommodated by the sector 17 of the rail foot supporting area 12, which is defined downwards by the concavely curved mold face 18 with its maximum depth of arc 19. Since steps have been taken to ensure that the maximum depth of the arc 19 of the concavely curved mold face 18 exceeds-even if only slightly—the maximum arc height 7 of the convexly crowned supporting surface 6, there is, in point of fact, no direct surface contact. Rather, surface contact between the rail foot supporting area 12 of the supporting plate or ribbed plate 8 and the supporting area 6 of the rail foot 2 is provided only along the two strip-like longitudinal edge zones that are defined by the sectors 13 and 14. The result of this is that a very stable, non-tilting fixing of the railroad rail 1 on the sole plate or ribbed plate 8 is ensured, and any tendency towards lateral displacement of the railroad rail is prevented.

Figure 3:
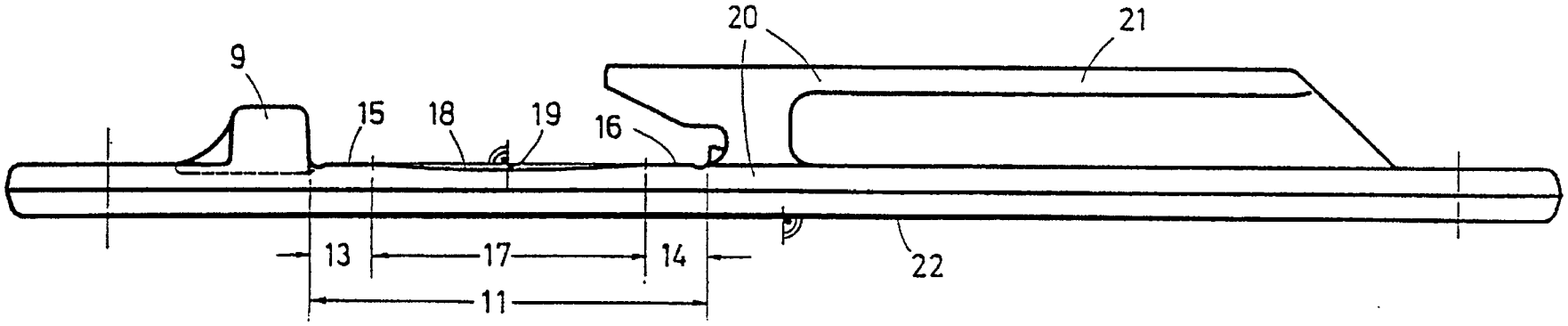
FIG. 3: a slide chair plate that is used for a rail attachment device in rail systems, in the vicinity of switches as a pole plate, which incorporates a foot support device for railroad rails as in FIG. 1, with a special support modification, which can be secured on a tie or an appropriate track-retaining element by means of carriage bolts.
Figure 4:
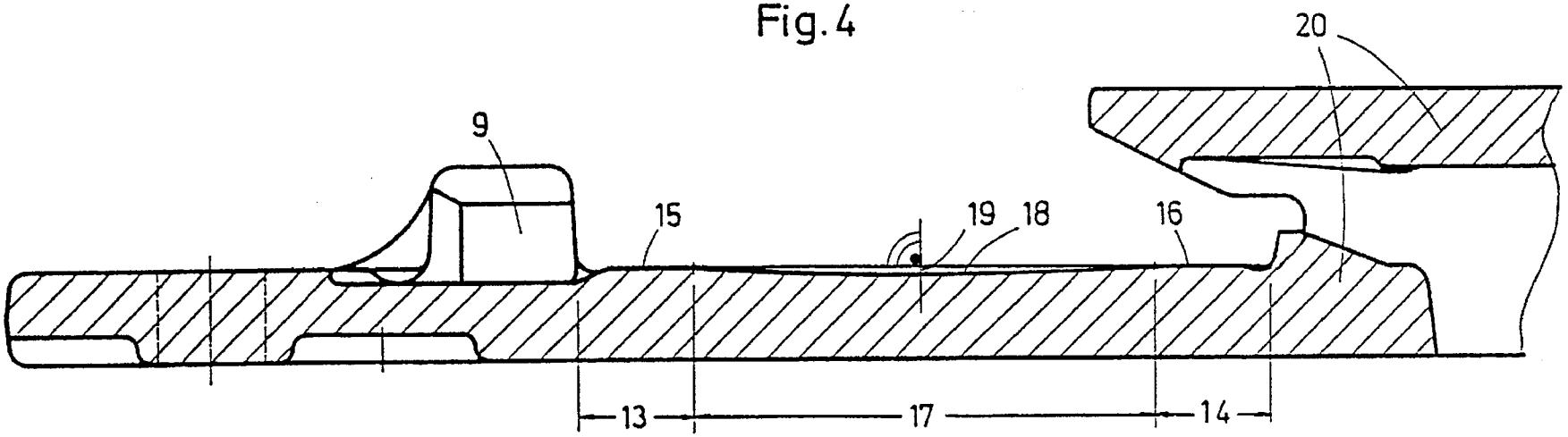
FIG. 4: the object of the present invention at greater scale and in cross-section according to a partial cross-section of the slide chair plate as in FIG. 3.

FIGS. 3 and 4 show that it is not only sole plates 8, which can be in the form of simple ribbed plate and also manufactured by rolling, forging, or casting, can be provided with foot support modifications for railroad rails 1 which exhibit the above-described features and advantages. For instance, FIGS. 3 and 4 show sole plates in the form of slide chair plates 20, these being of the sort that are used in switches in tongue devices, in particular inner and outer curve switches. Here it can be seen that the foot support modifications for these slide chair plates 20 incorporates the same arrangement and configuration features as have already been described on the basis of FIG. 2.

FIG. 3, in particular, shows that the sole plates that are configured as slide chair plates 20 are of a considerably greater length as is the case for normal ribbed plates 8 as shown in FIG. 2. This requirement is based on the presence of the integrated slide chair 21 and of the slide support surface for the moving switch blades.

The greater length of the slide chair plate 20 also results in the fact that the space between the coach bolts or the like that are required to secure it to the tie or to an appropriate track-retaining element has to be considerably greater. For this reason, in the case of such slide chair plates it can also happen that they assume a shape whereby they are curved in the longitudinal direction when they are flattened on the ties or the like, and that as a rule this curve will be concave, which is to say, the space between it and the top of the tie tends to increase towards the longitudinal center. This tendency, displayed by sole plates that are configured as a slide chair plate 20, can have a very negative effect on the advantageous effect of the foot support device for railroad rails that are provided in addition to the slide chair 20.

If the plates 8 or 20, respectively, are produced by casting, it may be necessary to subject the lateral sections 13 and 14 to metal-cutting processing to very narrow tolerance in thickness in order to achieve exact transverse and longitudinal parallellity of the flat supporting surfaces 15 and 16.

The object of achieving a stable, non-tilting support for the rail foot 2 of a railroad rail 1 on a sole plate, for example, a ribbed plate 8 or a slide chair plate 20, can also be achieved if the sole plate 8 in question is of a conventional construction, which is to say it does not incorporate the new support modification.

Figure 5:
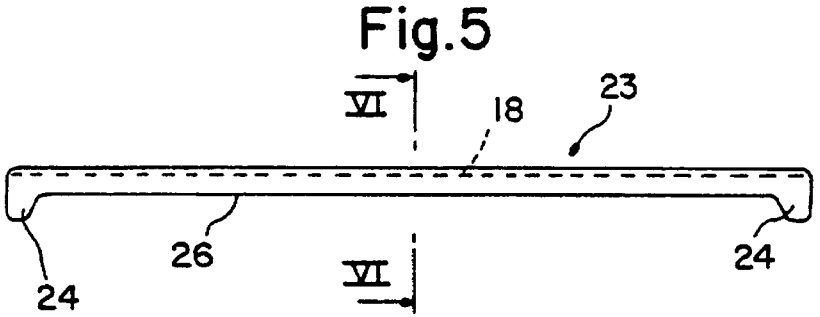
FIG. 5: a side view of a shim designed according to the present invention, which can be used as a foot support device for railroad rails in conjunction with base plates, namely rib plates, slide chair plates, or the like that are of conventional construction, in which the supporting surface is flat, e.g., with concrete ties.
Figure 6:
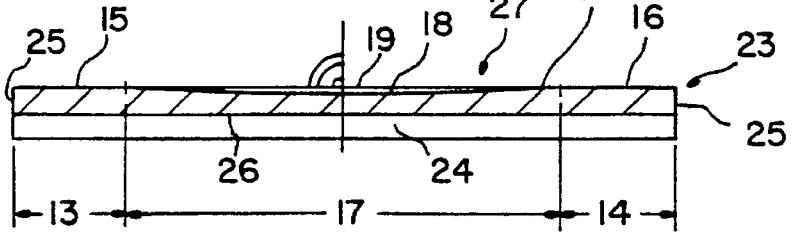
FIG. 6: a cross-section on the line VI—VI in FIG. 5.

All that is necessary in order to do this is to provide a special shim 23 for the ribbed plates 8 and the slide chair plates 20 that are of conventional construction, as can be seen in FIGS. 5 and 6. The shim 23 can be of rubber, plastic, or any other suitable material. On each of its ends that face away from each other, the shim 23 is provided with a lug 24 that projects downwards, and two lugs 24 can enclose the limiting edges of the sole plates, which are parallel to them, in a downwards direction so as to fix the shim 23. The lugs 24 are intended to ensure that the lug 23 is fixed on the upper side of the sole plate 8 in the longitudinal direction of the railroad rail 1 and that the lug is to be installed on the sole plate in such a way as to prevent the shim 23 from shifting. In contrast to this, fixing against lateral displacement of the shim 23 is maintained in that its longitudinal edges 25 rest between the rib profiles 9 and 10.

The underside 26 of the shim 23 is flat and thus maintains contact with the rail foot supporting area 12 of a normal sole plate 8 or even with the top of a concrete tie, across its whole area. However, on its upper side 30, the shim 23 has, for all practical purposes, the same shape as has been described above on the basis of the rail foot support area 12 of the support plate or the rib plate 8 shown in FIG. 2. There, there are two strip-like lateral sections 13 and 14, each with flat contact surfaces 15 and 16, whereas the sector 17 that lies between them has a concavely curved mold face 18 that has the greatest depth of arc 19.

If the shim 23 is installed in the rail foot support area 12 of a conventional sole plate or ribbed plate 8, the railroad rail 1 shown in FIG. 1 can be positioned safely in exactly the same way as is possible with the sole plate or ribbed plate 8 shown in FIG. 2.

In the case of ribbed plates that are of conventional construction, particularly those produced by rolling, it is quite possible that the rail foot support area 12 does not lie completely flat, in the desired way, because of flattening, but has a convexly curved contour imparted to it across the space 11 between the ribbed profiles 11 and 12. Then the convexly curved support surface 6 of the rail foot 2 and the surface of the rail foot support area 12 which is similarly curved convexly meet so that there is an increased tendency for the railroad rail 1 to tip since the rail is unstable on the plate, if it is tightened in the area of the rail-securing devices.

Figure 7:
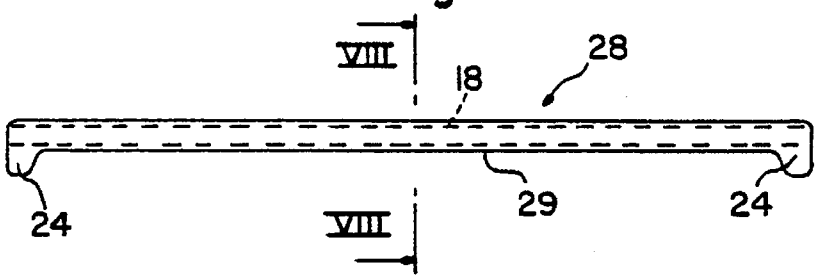
FIG. 7: a side view of a shim that is of modified construction vis-a-vis FIG. 5 in which the supporting surface of a plate is convexly curved.
Figure 8:
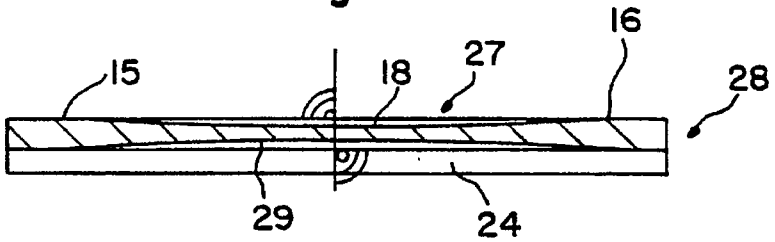
FIG. 8: a cross-section on the line VIII—VIII in FIG. 7.

These disadvantages can be eliminated by using a shim 28 of the type that is shown in FIGS. 7 and 8. The shim that is shown in FIGS. 7 and 8 is, in principle, of the same configuration as the shim 23 shown in FIGS. 5 and 6. The only difference is that in place of a flat underside 26 it has a concavely contoured mold face 29 as the underside and this extends across the whole width of the shim. Because of this, the curved configuration of the mold face 29 on the underside of the shim 28 is intended to correspond as precisely as possible to the convexly curved shape of the rail foot supporting area 12 of the sole plate or ribbed plate 8 that is produced by rolling, in order that the advantages of the particular configuration on the upper side 18 of the shim 28 can be exploited to maximum advantage in conjunction with railroad rails 1 as shown in FIG. 1.

We claim:

1. A foot support comprising a plate having a surface which receives a bottom of said rail foot, said surface defining two spaced flat surfaces in a common plane between which said two spaced flat surfaces in a common plane is a concave arc surface extending only transversely to the longitudinal direction of the rail and which said spaced flat surfaces in a common plane contact said foot and upon which rests two spaced longitudinal edge bottom surfaces of said foot, the bottom surfaces of said foot having a convex bottom surface between said two spaced longitudinal edge bottom surfaces of said foot, said convex bottom surface of said loot fitting within the concave surface of said plate without said concave and convex surfaces touching.

2. The foot support of claim 1, wherein the concave arc surface of said plate surface has a maximum depth of arc midway between said two spaced flat surfaces.

3. The foot support of claim 2, wherein a ratio of width of each flat surface to a total width of the surface is from 1:4 to 1:6.

4. The foot support of claim 2, wherein a ratio of the maximum depth of arc to a total width of the surface is from 1:166 to 1:100.

5. The foot support of claim 2, wherein the maximum depth of arc is from 0.6 to 1 mm.

6. The foot support of claim 1, wherein a ratio of the width of each flat surface to total width of the surface is from 1:4 to 1:6.

7. The foot support of claim 6, wherein a ratio of the maximum depth of arc to a total width of the surface is from 1:166 to 1:100.

8. The foot support of claim 6, wherein the maximum depth of arc is from 0.6 to 1 mm.

9. A foot support comprising a plate having a surface with downwardly extending spaced sides extending transversely to the longitudinal direction of the rail and a shim for fitting over said surface, said shim having a top surface for contacting a portion of a bottom of said rail foot and defining a surface having two spaced flat surfaces in a common plane between which said two spaced flat surfaces in a common plane is a concave arc surface extending only transversely to the longitudinal direction of the rail and downwardly extending lugs to fit over said downwardly extending spaced sides of said plate surface, said lugs extending transversely to the longitudinal direction of said rail to prevent movement of the shim in the longitudinal direction of the rail, said spaced flat surfaces in a common plane contacting said toot and upon which rests two spaced longitudinal edge bottom surfaces of said foot, the bottom surfaces of said foot having a convex bottom surface between said two spaced longitudinal edge bottom surfaces of said foot, said convex bottom surface of said foot fitting within the concave surface of said shim without said concave and convex surfaces touching.

10. The foot support of claim 9, wherein said shim has a bottom side defining a concave surface.

11. The foot support of claim 9, wherein said concave surface on the bottom of said shim extends between said lugs.

* * * * *